US009955833B2

(12) United States Patent
Lee et al.

(10) Patent No.: US 9,955,833 B2
(45) Date of Patent: May 1, 2018

(54) VACUUM CLEANER

(71) Applicant: LG Electronics Inc., Seoul (KR)

(72) Inventors: Changook Lee, Changwon-si (KR); Kiyong Song, Changwon-si (KR); Gunho Ha, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 671 days.

(21) Appl. No.: 14/109,449

(22) Filed: Dec. 17, 2013

(65) Prior Publication Data

US 2014/0182080 A1 Jul. 3, 2014

(30) Foreign Application Priority Data

Dec. 27, 2012 (KR) ..... 10-2012-0155271

(51) Int. Cl.
*A47L 9/04* (2006.01)
*A47L 5/26* (2006.01)
*A47L 7/00* (2006.01)

(52) U.S. Cl.
CPC ..... *A47L 9/0483* (2013.01); *A47L 5/26* (2013.01); *A47L 7/008* (2013.01)

(58) Field of Classification Search
None
See application file for complete search history.

(56) References Cited

U.S. PATENT DOCUMENTS 4,597,131 A * 7/1986 Lyman ..... A47L 9/22 15/412
2006/0236500 A1 10/2006 Oh et al.
2010/0043155 A1 2/2010 Chow
2010/0306953 A1 12/2010 Chan
2011/0088207 A1 4/2011 Lim
2012/0151711 A1* 6/2012 Lee ..... A47L 5/24 15/347

FOREIGN PATENT DOCUMENTS

| | | | |
|---|---|---|---|
| CN | 1463660 | A | 12/2003 |
| CN | 1535645 | A | 10/2004 |
| CN | 202113006 | U | 1/2012 |
| DE | 10040835 | A1 | 4/2001 |
| EP | 2319380 | A2 | 5/2011 |
| JP | 07051210 | | 2/1995 |
| JP | 3143069 | U | 7/2008 |
| JP | 2009066331 | | 4/2009 |
| KR | 2020090011457 | | 11/2009 |
| KR | 10-2011-0058966 | A | 6/2011 |
| KR | 200455643 | * | 9/2011 |
| KR | 1020110102605 | A | 9/2011 |
| RU | 2355567 | C1 | 5/2009 |
| RU | 2378972 | C2 | 1/2010 |

OTHER PUBLICATIONS

Machine Translation of KR 200455643.*

* cited by examiner

*Primary Examiner* — Christopher M Koehler
*Assistant Examiner* — Brian Keller
(74) *Attorney, Agent, or Firm* — Dentons US LLP

(57) ABSTRACT

A vacuum cleaner to suction dust by applying vibration includes a motor, an eccentric load applied to a rotating shaft of the motor which when rotated by a rotation of the rotating shaft produces vibration force, a vibration plate to apply the vibration force to an object to be cleaned, and a vibration transfer member to transfer vibration force to the vibration plate.

15 Claims, 10 Drawing Sheets

VACUUM CLEANER

This application claims the benefit of Korean Patent Application No. 10-2012-0155271, filed on Dec. 27, 2012, which is hereby incorporated by reference as if fully set forth herein.

BACKGROUND

Field of the Disclosure

The present disclosure relates to a cleaner, and more particularly, to a vacuum cleaner.

Background

A vacuum cleaner may be defined as an apparatus provided therein with a fan motor to suction in external air and dust to filter out dust. The vacuum cleaner is usually called a cleaner.

Cleaners are generally classified into canister vacuum cleaners, in which the body and the suction nozzle are connected to each other by an extension tube, and an upright cleaner, in which the body is directly connected to the suction nozzle.

As a portable cleaner, a hand-held type cleaner, in which the entire cleaner body is held by a user, is widely used.

In recent years, bedding cleaners capable of cleaning bedding have come into use along with increase in standard of living. The bedding cleaner is also a hand-held cleaner, but it may be provided with a vibration plate to apply vibration to the bedding, unlike typical hand-held cleaners.

The hand-held cleaner is generally designed to easily clean a portion of an object. Accordingly, the user may need not to take uncomfortable pose to handle the hand-held vacuum cleaner. This is also the case of the canister vacuum cleaner and the upright vacuum cleaner, which allow the user to perform cleaning without bending at the waist.

When the user uses the bedding cleaner to clean bedding, a substantial amount of time is generally required to clean the entire bedding. Accordingly, inconvenience resulting from the pose the user takes to perform cleaning may be a problem.

With reference to FIGS. 1 to 3, a detailed description will be given of a conventional cleaner, particularly of a bedding cleaner.

The bedding cleaner 1 may include an upper body 2, a handle 3, a nozzle body 5, and a lower body 4. The nozzle body 5 is arranged in parallel with the ground, particularly with the bedding, and cleaning of the bedding is performed through the nozzle body 4.

The nozzle body 5 may be provided with a nozzle 6 to draw in the external air, a vibration plate 7, and an agitator 8. The vibration plate 7 applies vibration to the bedding to lift dust from the bedding, and the agitator 8 sweeps the dust on the surface of the bedding. Accordingly, through operation of the vibration plate 7 and the agitator 8, the bedding is more effectively cleaned.

The lower body 4 extends rearward from the nozzle body 5 to be substantially parallel to the ground. The body of the cleaner may be formed by coupling the upper body 2 to the upper portions of the lower body 4 and the nozzle body 5.

The lower body 4 is provided with a roller 9 to support the cleaner on the ground. By the roller 9 and the agitator 8, the cleaner may be substantially supported on the ground or the bedding.

As shown in FIG. 3, the user holds the handle 3 and moves the cleaner back and forth to clean the bedding.

However, the conventional bedding cleaner is not tall, as seen in FIG. 3. Accordingly, the user needs to bend at the waist for a long time to clean the bedding.

In addition, due to difference in position between the cleaner the upper body 2 and the handle 3, applying force to the ground or the bedding is not easy. During cleaning, the user applies force only forward and rearward, and thus the nozzle body 5 may not closely contact the ground or the bedding. Thereby, cleaning may not be performed effectively since vibration is not sufficiently applied to the bedding.

To increase the height of the cleaner, the position of the handle 3 may be raised. However, in this case, the upper body 2 of the cleaner is elongated in the front-back direction, and therefore the shape of the body 2 may not match the raised shape of the handle 3. Thereby, the overall external appearance of the cleaner may not be elegant since the handle 3 is raised excessively high, compared to the upper body 2 of the cleaner.

Moreover, the upper body 2 and the handle 3 are separately provided and connected to each other. Accordingly, increasing the height of the handle 3 increases the entire size of the outer shape of the cleaner, resulting in inconvenience in handling and storing of the cleaner.

To ensure stable movement, the center of gravity of the cleaner is positioned between the agitator 8 and the roller 9. However, since the center of gravity of the cleaner is too close to the ground, the distance of moment from the center of gravity to the force applied to the handle 3 to move the cleaner may increase. For this reason, the nozzle body 5 may not closely contact the ground or the bedding, as discussed above.

In addition, since the lower body 4 and the nozzle body 5 are horizontally arranged to correspond to the ground, travel of the cleaner for cleaning may not be easy. This is because a section of the cleaner that is not directly related to cleaning becomes close to the ground. In other words, this arrangement may not facilitate increase in the area of the cleaning region, i.e., the area of the nozzle body 5. Accordingly, a travel distance per hour for effective cleaning may be shortened. This may eventually result in a long cleaning time.

In the cleaner 1 shown in FIG. 3, the flow path is curved several times, resulting in high air resistance.

Air introduced through an air guide 11 first flows into a dust container 12. In the air guide 11, the air is directed upward, then rearward, and then upward again. The air introduced into the dust container 12 is discharged rearward from the dust container and introduced into a fan motor 13. After introduction into the fan motor 13, the air is discharged outside through one side of the fan motor 13 (the side directed into the paper).

Due to the structure of the flow path as above, the direction of flow of air is frequently changes while the air introduced into the cleaner is discharged outside. Accordingly, noise increases and smooth cleaning may not be performed. In addition, additional constituents may be further provided to shield the noise, and thus the structure of the fan motor chamber to accommodate the fan motor may become complex.

FIG. 4 shows a vibration system of a conventional cleaner to drive the vibration plate 7 shown in FIG. 2.

When the motor 14 rotates, the produced rotational force is transferred to a reduction gear 16 via a belt 15. Accordingly, rotation of the motor does not produce vibration.

Specifically, torque is enhanced by the belt 15, and vibration is produced by an eccentric bearing 17. The produced vibration is transferred to the vibration plate 7 via a connection member 18. The connection member 18 is elastically supported by the nozzle body 5 through an elastic member 19. Accordingly, a complex structure of connection between the motor 14 and the vibration plate 7 may be produced.

Such a connection structure may make the air flow path in the suction nozzle part complex. In addition, due to many complex constituents, durability of the cleaner may be degraded. Since a structure for holding the eccentric bearing 17 in addition to the structure for fixing of the motor is added, manufacture of the cleaner may become complex.

Therefore, a cleaner having a vibration system which may be easily implemented and enhance durability, reliability and vibration effects may need to be provided.

SUMMARY

Accordingly, the present disclosure is directed to a cleaner that substantially obviates one or more problems due to limitations and disadvantages discussed in the background.

One object is to provide a cleaner having a vibration system which may be easily implemented and have enhanced durability and reliability.

Another object is to provide a cleaner which may enhance the vibration effect by allowing a motor to vibrate and converting vibration of the motor into vibration of a vibration plate.

Another object is to provide a cleaner that may simplify and facilitate fixing of the vibration system.

Another object is to provide a cleaner that may enhance cleaning effect by vibrating two vibration plates through one vibration motor.

Another object is to provide a cleaner which may easily maintain balance between two vibration plates by positioning a vibration motor over a suction port.

Another object is to provide a cleaner which may minimize inconvenience of bending at the waist during cleaning and may be thus easy to use.

Another object is to provide a cleaner which may enhance cleaning effect by allowing the nozzle part to more closely contact the ground or the bedding.

Another object is to provide a cleaner that may secure travel stability during cleaning and may thus be easy to use.

A further object is to provide a cleaner which may enhance cleaning efficiency and reduce noise by ensuring smoother flow of air in the cleaner.

Additional advantages, objects, and features may be set forth in part in the description which follows and in part may become apparent to those having ordinary skill in the art upon examination of the following or may be learned from practice of the invention. The objectives and other advantages may be realized and attained by the structure particularly pointed out in the written description and claims hereof as well as the appended drawings.

To achieve these objects and other advantages and in accordance with the purpose of the invention, as embodied and broadly described herein, a vacuum cleaner to suction dust by applying vibration includes a body, a suction nozzle part at a portion of the body, a motor including a rotating shaft in the body, an eccentric load at the rotating shaft of the motor, which when rotated by a rotation of the rotating shaft, produces a vibration force, a vibration plate located at the suction nozzle part to apply the vibration force to an object to be cleaned, and a vibration transfer member to transfer the vibration force to the vibration plate.

The eccentric load may be realized with an eccentric weight connected to the rotating shaft. By the rotation of the eccentric weight, force may be generated in a direction tangential to the circle of rotation, and the entire motor may be vibrated by the force.

The vibration transfer member may include a motor accommodation portion to accommodate the motor, and at least one connection member to connect the motor accommodation portion to the vibration plate.

The connection member may be arranged to transfer vibration of the motor and the motor accommodation portion to the vibration plate. Specifically, the connection member may be arranged to convert vibration of the motor and the motor accommodation portion into rotational motion having a limited rotational angle to transfer the vibration to the vibration plate. To limit the rotational angle, an elastic member may be provided.

Preferably, the motor accommodation portion is provided with at least one hinge pivot, and the connection member is rotatably connected to the hinge pivot.

Preferably, the connection member is formed to extend from the hinge pivot to front and rear sides of the hinge pivot.

Preferably, front and rear portions of the connection member defined with respect to the hinge pivot vibrate in crossing directions.

The hinge pivot is preferably arranged at a lower portion of the rotating shaft of the motor and spaced apart from the rotating shaft. The hinge pivot is preferably eccentrically positioned forward or rearward of the rotating shaft of the motor in a horizontal direction of the rotating shaft.

Due to eccentric relation between the rotating shaft of the motor and the hinge pivot, rotation force is produced at the hinge pivot. In addition, the directions of the rotational force are alternated. Accordingly, such rotational force causes rotation of the connection member, resulting in vertical vibration of the end of the connection member.

The at least one hinge pivot may be provided on both sides (left and right sides) of the motor, and the at least one connection member may be provided to each of the at least one hinge pivot.

The at least one hinge pivot may include two hinge pivot coaxially arranged and separate vibration plates may be provided at both sides of each of the hinge pivots and connected to a corresponding one of the at least one connection member. Accordingly, it is possible to vibrate two vibration plates using one motor. In addition, the vibration system may be symmetrically formed on both sides of the motor.

Accordingly, by increasing the vibration area, the effect of cleaning through vibration may be further enhanced. In addition, since it is possible to double the number of vibrations per second, the effect of cleaning may be further enhanced.

Preferably, the vacuum cleaner further includes a suction nozzle part body formed to correspond to the ground, wherein the motor, and the vibration plate and the connection member are elastically supported by the body through an elastic member.

The elastic member may be arranged between the connection member and the body and fixed, and amplitude of vertical vibration of the vibration plate may be restricted by elastic force of the elastic member.

In another aspect, a vacuum cleaner may include a body, a suction nozzle part provided at a portion of the body to suction dust by applying vibration to an object. The suction nozzle part includes a suction port, and a vibration system including a motor caused to vibrate by an eccentric load applied to a rotating shaft of the motor and at least one vibration plate located at the suction nozzle part to apply vibration to the object, and an elastic member, wherein the vibration system may be elastically supported by the body with respect to a direction of vibration of the vibration plate by the elastic member.

The at least one vibration plate may be individually provided to front and back of the suction port.

The at least one vibration plate may vibrate in crossing directions.

The vibration system may include a motor accommodation portion, at least one hinge pivot provided to the motor accommodation portion, and at least one connection member extending to front and rear side of the hinge pivot and connected to the vibration plate.

The at least one hinge pivot may be provided on both sides (left and right sides) of the motor accommodation portion, separate vibration plates are arranged at front and rear sides of the motor accommodation portion and connected to the connection member. Accordingly, the vibration plates may vibrate in the crossing directions.

The vacuum cleaner preferably includes a hinge pivot fixing member to fix the hinge pivot to the body. By the hinge pivot fixing member, translational movement of the vibration motor and the motor accommodation portion may be restricted. This is because the force in this direction, i.e., the force to make translational movement may be converted into rotational force at the hinge pivot.

The motor accommodation portion may include a motor seating portion, and a spacing member to form the hinge pivot such that the hinge pivot may be spaced apart from the motor seating portion.

The motor accommodation portion may include a motor accommodation portion cover joined to the spacing member to cover the motor seating portion and spaced apart from the motor seating portion.

The vacuum cleaner may further include a handle allowing a user to apply force thereto to manipulate the vacuum cleaner.

In another aspect, a vacuum cleaner may include a suction nozzle part horizontally formed to correspond to the ground, a fan motor installation portion extending backward from the suction nozzle part and inclined upward, and a body cover joined to the upper portion of the suction nozzle part and a motor installation portion.

Preferably, the suction nozzle part and the fan motor installation portion are integrated with each other to form a single base body.

A vibration motor may be arranged at the upper portion of the base body (the first base body) corresponding to the suction nozzle part, a vibration plate to apply the vibration generated by the vibration motor to the ground may be arranged at the lower portion of the first base body.

A battery to apply power to the cleaner may be arranged at the upper portion of the first base body. The cleaner may be selectively configured to be of the power source-connection type or the charging type. Accordingly, a battery seating portion to seat the battery may be provided regardless of whether the cleaner is of the power source-connection type or the charging type.

In the case that the battery is seated on the battery seating portion, the charging type cleaner is implemented. In the case that the battery is not seated on the battery seating portion, the power source-connection type cleaner is implemented. In the case of the power source-connection type cleaner, a power cord need to be provided to apply power to the cleaner.

Herein, the battery seating portion is preferably provided at the front upper portion of the first base body. Thereby, the center of gravity of the cleaner may be positioned forward.

The base body corresponding to the fan motor installation portion (a second base body) is preferably formed to have a height from the ground increasing as the second base body extends rearward.

A fan motor is preferably provided to the base body corresponding to the fan motor installation portion (the second base body) such that the central axis of the fan motor is diagonally arranged with respect to the ground. That is, the fan motor is preferably diagonally provided to the second base body which is diagonally arranged. Thereby, a flow path substantially parallel with the diagonal direction of the body may be formed.

The cleaner may include a support provided at the rear side of the suction nozzle part and at the lower portion of the fan motor installation portion to support the cleaner in addition to the suction nozzle part on the ground.

The center of gravity of the bedding cleaner is preferably positioned forward of the support. The support preferably includes a support bracket and at least one wheel provided to the support bracket. One wheel may be provided, but in consideration of lateral position of the center of gravity, two wheels are preferably provided on both sides of the cleaner.

To compensate the difference in height between the fan motor installation portion and the ground, the support bracket preferably extends downward from the fan motor installation portion. The support bracket preferably extends downward from only one portion of the lateral width of a second base body to minimize the area of the support bracket contacting the ground. That is, the support bracket preferably extends downward from only a part of the lateral center portion of the base body.

Preferably, the center of gravity of the fan motor arranged at the fan motor installation portion is positioned over the front of the wheels, and the center of gravity of the cleaner is positioned perpendicularly over the fan motor installation portion with respect to the ground.

The cleaner may include a handle allowing a user to apply force thereto to manipulate the cleaner.

In another aspect, a vacuum cleaner may include a suction nozzle part horizontally formed to correspond to the ground, a body extending rearward from the upper portion of the suction nozzle part and inclined upward such that the height thereof increases as the body extends rearward, a handle provided to the body to allow a user to apply force thereto, a dust container mounted to the body, and a fan motor provided in the body and arranged at the back of the dust container to suction dust, wherein an air flow path extending from the dust container to the fan motor may be formed to be inclined upward as the flow path extends rearward in the body.

The dust container may be mounted to and detached from the body in a direction substantially perpendicular to the direction of inclination of the body.

The cleaner may include an air guide to the air introduced from the suction nozzle part to the rear upper side such that the air is supplied to the dust container. The air guide is preferably inclined upward as the air guide extends rearward from the suction port. Thereby, a vibration motor may be positioned over the suction port.

Since the suction port substantially forms the center of the suction nozzle part, balance between the vibration plates provided to the front and rear sides of the suction nozzle part may be easily maintained. This is because the vibration motor is provided at the center of the suction nozzle part, and the vibration system may be implemented such the front and rear portions of the vibration system defined with respect to the vibration motor are symmetrical to each other.

The dust container may include a dust container outlet communicating with the fan motor and arranged substantially perpendicular to the direction of inclination of the body, and a dust container inlet communicating with the air guide and arranged to be more inclined toward the suction nozzle part than the dust container outlet.

The fan motor is preferably mounted to the body with the rotating shaft thereof inclined with respect to the ground to correspond to inclination of the body. Thereby, an air flow path corresponding to the inclination of the body may be formed.

Preferably, the air introduced into the fan motor is discharged to the upper portion of the fan motor and then discharged from through the lower lateral sides of the body.

The cleaner may include a support provided at the rear side of the suction nozzle part and at the lower portion of the body to support the bedding cleaner in addition to the suction nozzle part on the ground.

The handle is preferably arranged at the rear upper portion of the body. The handle is preferably formed to have a round-shaped grip. In addition, the direction of force applied through the handle is preferably parallel with the direction of inclination of the body.

The handle may be provided by penetrating the body, and may be integrated with the body.

The body may include a first base body defining the suction nozzle part, a second base body extending rearward of the body to be inclined upward, a fan motor being mounted to the second base body, and a body cover joined to the upper side of the first base body and the second base body.

Preferably, body discharge ports through which air is discharged are provided to the both sides of the second base body.

Preferably, the cleaner includes a vibration plate provided to the suction nozzle part to apply vibration to the ground.

The vibration plate is preferably positioned, at the position where the cleaner operates, to be visibly exposed to the outside of the cleaner. Thereby, the user may easily check whether cleaning is normally performed. Therefore, reliability of cleaning and product reliability may be enhanced.

In another aspect, a vacuum cleaner may include a suction nozzle part provided with vibration plates at the front and back of a suction port through which external air is introduced, and horizontally formed with respect to the ground, a body extending rearward from the upper portion of the suction nozzle part and inclined upward such that the height thereof from the ground increases as the body extends rearward, the body being provided therein with a dust container and a fan motor, and a support arranged at the rear side of the suction nozzle part to be spaced apart from the suction nozzle part and extending downward from the lower portion of the body toward the ground to support the suction nozzle part and the body such that the suction nozzle part and the body do not contact the ground. Preferably, the suction nozzle part is formed in a circular shape.

Preferably, the cleaner includes a handle provided to the rear upper portion of the body such that the force applied by a user to travel the bedding cleaner is parallel with the direction of inclination of the body.

Embodiments described herein may be combined in any combination, except mutually exclusive combinations. Accordingly, effects of the embodiments may also be combined.

It is to be understood that both the foregoing general description and the following detailed description are exemplary and explanatory and are intended to provide further explanation of the embodiments of the present invention.

BRIEF DESCRIPTION OF THE DRAWINGS

The accompanying drawings, which are included to provide a further understanding of the disclosure and are incorporated in and constitute a part of this application, illustrate embodiment(s) of the invention and together with the description serve to explain the principle of the invention. In the drawings.

DETAILED DESCRIPTION OF THE INVENTION

Figure 1:
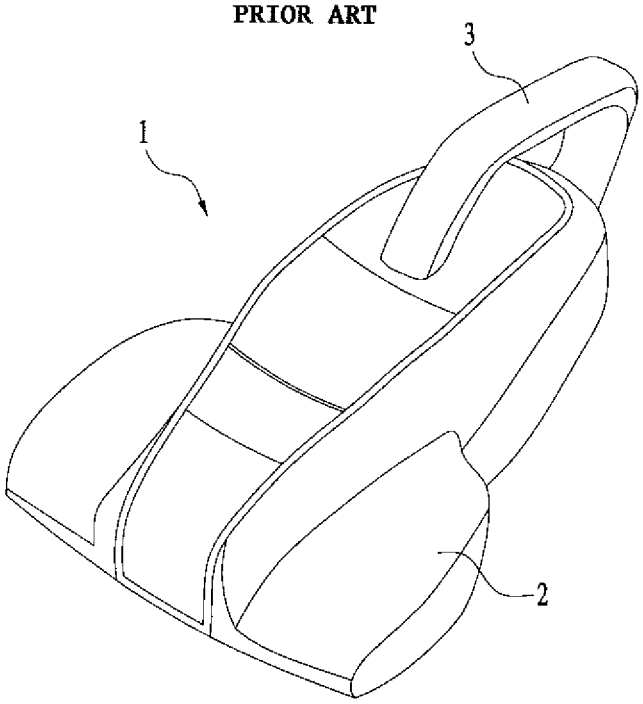
FIG. 1 PRIOR ART
FIG. 1 is a perspective view illustrating a conventional bedding cleaner.

Reference will now be made in detail to the preferred embodiments of the present invention, examples of which are illustrated in the accompanying drawings. Wherever possible, the same reference numbers may be used throughout the drawings to refer to the same or like parts.

A description will first be given of a cleaner 200 according to one embodiment with reference to FIGS. 5 to 7.

The cleaner 200 include a body or a main body 20. That is, the cleaner 200 includes a main body 20 forming the overall outer shape of the cleaner. The main body 20 is preferably inclined at an angle with respect to the ground. That is, the centerline S of the main body 20 is inclined backward at an angle with respect to the ground. Thereby, the height of the main body 20 with respect to the ground increases as the main body 20 extends backward.

The angle $\alpha$ between the centerline S and the ground is preferably between 30° and 50°, more preferably, about 40°. If the angle increases above this range, the center of gravity of the cleaner may be raised excessively high. If the angle decreases below this range, the cleaner may undergo the same problems as the conventional cleaner.

The cleaner 200 includes a suction nozzle part 25 arranged horizontally to correspond to the ground or the bedding horizontally placed on a bed. That is, the suction nozzle part 25 corresponds to a cleaning region. Accordingly, the suction nozzle part 25 forms the front lower portion of the main body 20. In other words, the main body 20 preferably extends backward from the upper portion of the suction nozzle part 25 to be inclined upward.

The lower portion of the main body 20 may be defined as a base body 22. Accordingly, the front portion of the base body 22 may be defined as a suction nozzle part body or a first base body 23. In other words, the base body 22 corresponding to the suction nozzle part 25 may be defined as the first base body 23.

A second base body 24 may be formed to be inclined upward as it extends backward from the first base body 23. In other words, the front portion of the base body 22 may be defined as the first base body 23, and the rear portion of the base body 22 may be defined as the second base body 24.

Thereby, the first base body 23 may be formed to be parallel with the ground, and the height of the second base body 24 from the ground may increase as the second base 24 extends backward. Preferably, the inclination angle between the second base body 24 and the ground is substantially equal to the inclination angle $\alpha$ between the centerline S of the main body 20 and the ground. Preferably, the second base body 24 is continuously inclined as it extends backward from the first base body 23.

A support 70 may be provided to the lower portion of the second base body 24 to support the main body 20 with respect to the ground. In addition, a handle 80 may be provided to the rear upper side of the main body 20.

The user may grip the handle 80 and apply force to the cleaner such that the cleaner moves back and forth with the suction nozzle part 25 coming in close contact with the bedding.

The main body 20 may include a body cover 21 forming the upper portion thereof. The body cover 21 may be joined to the base body 22 to define an inner space. Various constituents described below may be positioned in the inner space.

Figure 7:
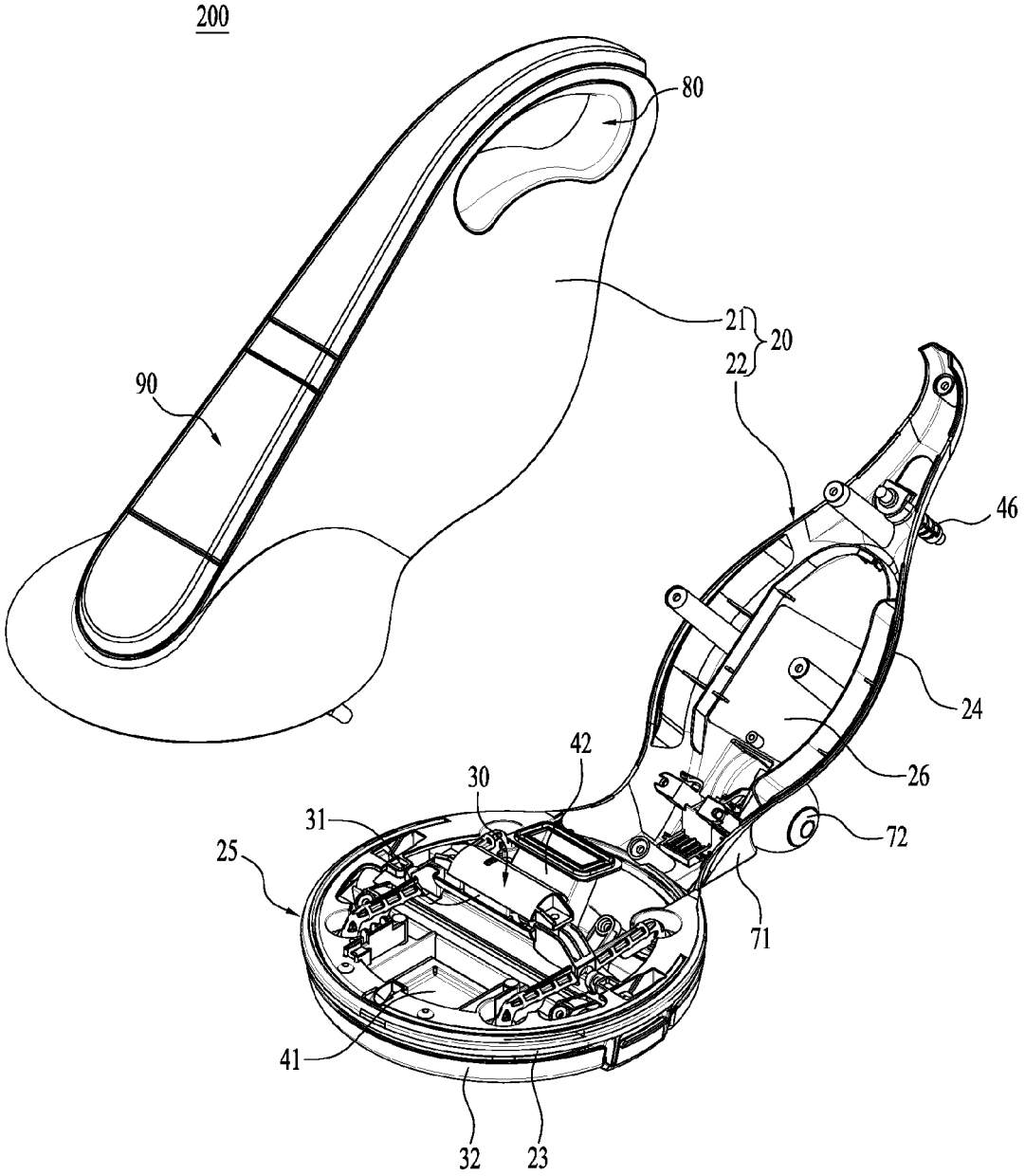
FIG. 7 is an exploded perspective view illustrating a main body of the cleaner shown in FIG. 5.

FIG. 7 shows the body cover 21 and base body 22, which are separated from each other.

The cleaner 200 may include a suction nozzle part 25 arranged to be parallel with the ground, and a fan motor installation portion 26 extending backward from the suction nozzle part 25 and inclined upward.

The suction nozzle part 25 may be integrated with the fan motor installation portion 26 to form the base body 22.

The base body 22 may include the first base body 23 corresponding to the suction nozzle part 25 and the second base body 24 corresponding to the fan motor installation portion 26. Accordingly, the second base body 24 is preferably integrated with the first base body 23. In addition, the second base body 24 is preferably inclined upward as it extends backward from the first base body 23.

The body cover 21 is arranged at the upper portion of the base body 22. The body cover 21 is joined to the base body 22 to form the overall external appearance of the cleaner.

The shape of the body cover 21 preferably matches the shape of the base body 22. Accordingly, the body cover 21 is preferably formed to be inclined upward as it extends backward.

A dust container 90 may be mounted through the inclined front surface of the body cover 21. Preferably, the mounting direction of the dust container 90 is substantially perpendicular to the direction of inclination of the cleaner 200. Thereby, smoother airflow may be generated in the dust container 90, as discussed below.

Preferably, the first base body 23 is provided with a vibration system 30. The vibration system 30 may include a vibration motor 31 and a vibration plate 32.

The vibration motor 31 may be arranged at the upper portion of the first base body 23, and the vibration plate 32 may be arranged at the lower portion of the first base body 23. In other words, the suction nozzle part 25 may be provided with the vibration motor 31 and the vibration plate 32. Vibration generated by the vibration motor 31 is transferred to the vibration plate 32. The vibration plate 32 is positioned to be parallel with the ground or the bedding and vibrates vertically. Accordingly, the vibration plate 32 applies vibration to the bedding to separate dust from the bedding.

A power cord 46 may be provided at the back of the second base body 24. Accordingly, power to operate the cleaner may be supplied to the cleaner through the power cord 46.

Since the cleaner 200 is applicable to a bedding cleaner, the cleaning region may correspond to the area of the bedding. Accordingly, unlike the canister cleaners or upright cleaners, the cleaning region may be relatively small. Therefore, the power cord may be relatively short.

The cleaner 200 according to an alternative embodiment may be selectively provided with a battery (not shown), rather than the power cord 46. That is, the power cord 46 may be omitted and instead a battery may be installed. Thereby, when the cleaner 200 is mounted on a charging station (not shown), the battery may be charged. Accordingly, the same cleaner may be selectively configured to be of the charging type or the power source-connection type.

To mount the battery to the cleaner, a battery mount 41 may be provided at the upper portion of the first base body 23. That is, a battery to apply power to the cleaner may be arranged at the upper portion of the first base body 23. To allow selective mounting of the battery, the battery mount 41 may be provided regardless of whether the cleaner is of the charging type or the power source-connection type.

The battery is relatively heavy. Accordingly, depending on the position where the battery is mounted, the position of the center of gravity of the cleaner 200 may vary.

As described above, the height of the cleaner from the ground increases as the cleaner extends backward. Accordingly, to secure convenient travel, the center of gravity needs to be positioned at a lower level and moved forward.

To provide a very effective flow path, the battery may be mounted to the upper portion of the first base body 23.

In addition, the battery mount 41 is more preferably positioned at the front of the suction nozzle part 25. Thereby, the center of gravity of the cleaner 200 may be positioned further forward. Due to the position where the battery is mounted, travel stability may be further enhanced.

A power source-connection type cleaner may be provided in place of the recharging type cleaner, as described below. That is, a cleaner that performs cleaning only when the power cord 46 is connected to a power source. In this case, there is no battery equipped in the main body 20, and therefore the center of gravity of the cleaner 200 may be moved backward of the main body 20.

Hereinafter, the center of gravity and support structure of the cleaner according to this embodiment will be described in detail with reference to FIGS. 5 to 7. More specifically, a description will be given of a power source-connection type cleaner rather than the recharging type cleaner (the cleaner having a battery).

When cleaning is performed, the body or main body 20 of the cleaner is substantially supported by an agitator 44. That is, by the agitator 44, which is arranged at the suction nozzle part 25, the cleaner is supported on the ground.

However, the main body 20 is formed to be inclined backward of the agitator 44, more specifically, to be inclined upward as it extends backward of the agitator 44. Accordingly, the support 70 to support the cleaner is preferably arranged at the rear side of the agitator 44.

The support 70 is preferably arranged at the rear side of the suction nozzle part 25 and at the lower portion of the fan motor installation portion 26. In other words, the support 70 is preferably provided to the second base body 24 rather than to the first base body 23. That is, the support point defined by the support 70 is positioned at a lower portion of the second base body 24 with respect to the ground.

Herein, the center of gravity of the cleaner 200 is preferably positioned at the front side of the support 70. In addition, the center of gravity is preferably positioned at the rear side of the suction nozzle part 25. More specifically, the center of gravity of the cleaner 200 is preferably positioned over the ground and forward of the second base body 24 and the support point.

Accordingly, the positional relation between the center of gravity of the cleaner 200, the agitator 44 and the support 70 may allow the cleaner 200 to be more stably supported and improve travel stability of the cleaner during cleaning. Thereby, convenience of using the cleaner may be enhanced.

The support 70 preferably includes a support bracket 71 and a wheel 72. The wheel 72 may be rotatably fixed to the support bracket 71. The wheel 72 and the agitator 44 together may form the support point for support of the cleaner 200 on the ground.

To compensate the difference in height between the fan motor installation portion 26 and the ground, the support bracket 71 preferably extends downward from the fan motor installation portion 26. That is, the support bracket 71 preferably extends from the lower portion of the second base body 24 toward the ground.

Figure 6:
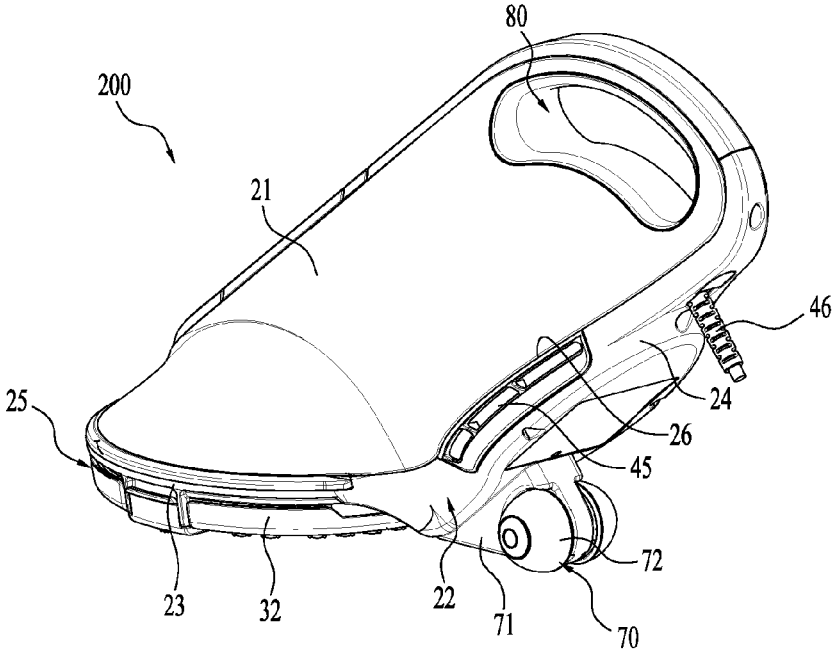
FIG. 6 is a perspective view illustrating the cleaner shown in FIG. 5.

As shown in FIG. 6, the support bracket 71 extends downward from one portion of the lateral width of a second base body 40. This means that the area of the support bracket 71 contacting the ground is small.

Accordingly, the area irrelevant to the cleaning region, i.e., the area which is not involved in cleaning but may contact the ground or the bedding may be minimized.

The wheels 72 may be provided on the left and right sides of the support bracket 71. In addition, the center of gravity of the cleaner may be positioned between the left and right wheels 72. Thereby, when the cleaner travels, shaking of the cleaner to the left and right may be prevented. As a result, stabler cleaning may be performed.

Traveling of the cleaner 100 is performed as the user applies force to the cleaner 100, holding the handle 80.

Figure 5:
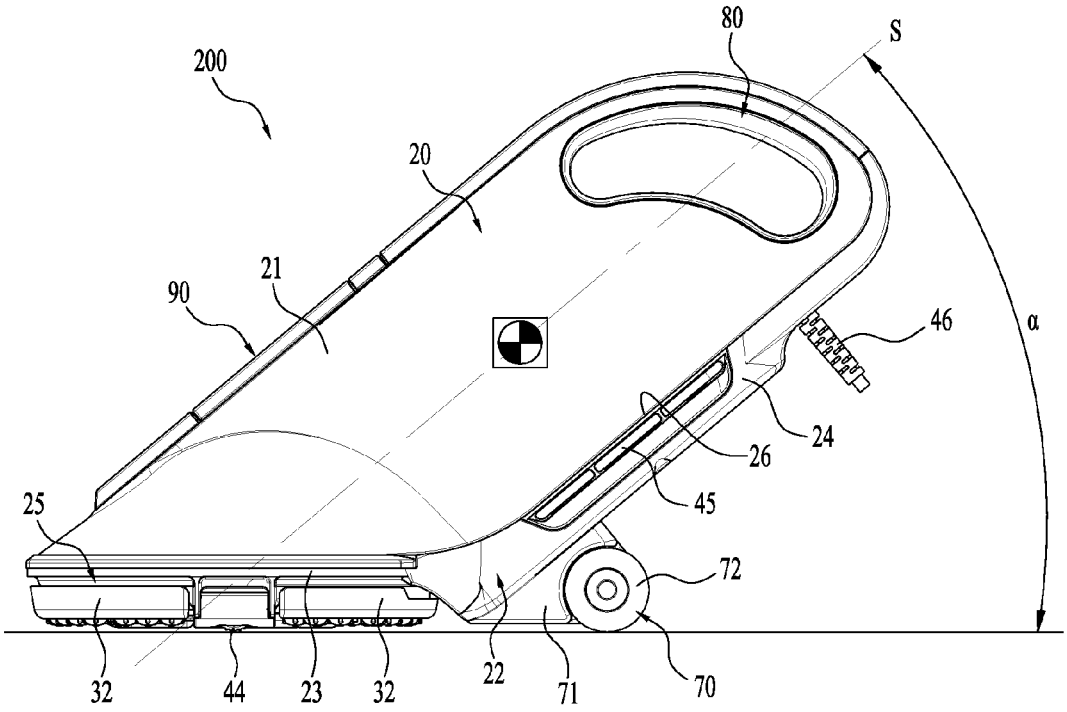
FIG. 5 is a cross-sectional view illustrating a cleaner according to one embodiment of the present invention.

As shown in FIG. 5, the handle 80 is formed in a round shape. Accordingly, the handle 80 is easy to grip and fatigue of the wrist may be reduced.

Specifically, the handle 80 is positioned at the rear upper portion of the body 20. To provide an elegant design and facilitate handling of the cleaner, the handle 80 is preferably integrated with the body 20. For example, the handle 80 may be formed by penetrating a portion of the body 20.

More specifically, the handle 80 may be formed in the shape of a closed curve by penetrating a portion of the body 20. Particularly, the handle 80 may be provided to the body cover 21.

The shape and position of the handle 80 as above allow the user to apply force to the body 20 in the direction parallel with the direction of inclination of the body to move the cleaner. That is, to move the cleaner forward, force may be easily applied not only forward but also downward. This is because the force applied in the direction of inclination may be divided into a forward component and a downward component.

The downward component of the force applied through the handle 80 causes the suction nozzle part 25 to more closely contact the ground. Accordingly, the effect of cleaning may be further enhanced.

Hereinafter, the structure of a flow path of a cleaner 200 according to one embodiment of the present invention will be described in detail with reference to FIGS. 8 and 9.

Air and dust are introduced into the cleaner 200 from the ground or the bedding through an air guide 42. The air guide 42 may be inclined backward with respect to the ground.

The air guide 42 may be connected to the dust container 90 to communicate with the dust container 90. That is, the air guide 42 guides the air introduced from the suction nozzle part 25 to the rear upper side such that the air is supplied to the dust container 90.

The dust container 90 may be mounted to and detached from the body 20 in a direction substantially perpendicular to the direction of inclination of the body 20.

The dust container 90 may include a chamber 91 to accommodate dust, a dust container inlet 94 through which dust is introduced, and a dust container outlet 95 through which dust is discharged.

The dust container outlet 95 may be arranged in a direction substantially perpendicular to the direction of inclination of the body 20. The dust container outlet 95 may be formed in the shape of a through hole in a mesh-shaped partition wall 93. In addition, a filter 92 may be provided at the front side of the partition wall 93. Thereby, dust may be separated from the air by the filter 92, and the air may be introduced into a fan motor assembly 50 via the dust container outlet 95.

The dust container inlet 94 communicates with the air guide 42. In addition, the dust container inlet 94 is more inclined toward the suction nozzle part 25 than the dust container outlet 95. In other words, the dust container inlet 94 may be more horizontally inclined with respect to the ground.

Due to the positional relations between the air guide 42, the dust container inlet 94 and the dust container outlet 95, the air flows rearward substantially in the direction of inclination. In other words, lateral, vertical and longitudinal change of direction of the flow path may be remarkably prevented.

Moreover, such flow direction of air is substantially identical to the direction in which the air flows into the fan motor assembly 50. Accordingly, air may be smoothly suctioned, and airflow resistance may be minimized.

Preferably, the fan motor assembly 50 is mounted to the fan motor installation portion 26. The fan motor installation portion 26 may be provided to the second base body 24 which is inclined rearward. Accordingly, the fan motor assembly 50 is preferably mounted to the fan motor installation portion 26 so as to be inclined rearward. That is, the central axis of the fan motor assembly 50 is preferably substantially identical to the centerline S of the body 20.

Due to the position where the fan motor assembly 50 is mounted, the direction of flow path in the body 24 may be substantially parallel with or identical to the centerline S of the body 20. Moreover, due to the mounting position of the fan motor assembly 50, the central axis of the fan motor 51 causing inflow of air is also inclined with respect to the ground.

The air discharged from the dust container outlet 95 is introduced into motor chambers 52 and 53, which surround the fan motor 51, via a packing 55. The motor chambers 52 and 53 may include an upper motor chamber 52 and a lower motor chamber 53. Accordingly, the upper motor chamber 52 is joined to the lower motor chamber 53 to define an inner space, and the fan motor 51 may be installed in the inner space.

The motor chambers 52 and 53 may function as a guide to guide the air introduced into the chambers to a discharge direction of the air.

A filter 54 may be provided to the upper portion of the upper motor chamber 52. That is, the filter 54 may be provided to ultimately filter out very fine dust in the body 20.

The air discharged via the filter 54 may be moved downward from both lateral sides of the motor chambers 52 and 53 and then discharged to the outside through body discharge ports 45 provided at both sides of the first base body 26.

Herein, a sufficient space may be secured in the body 20, particularly between the inner side of the body cover 21 and the outer side of the motor chambers 52 and 53. Accordingly, the air may be more smoothly discharged. This is because the flow rate of the discharged air may be reduced as the space on the lateral side of the body cover 21 is utilized to discharge the air. As the flow rate is reduced, noise caused by the discharged air may be remarkably reduced.

For this reason, the motor chambers 52 and 53 may be simplified. That is, it may be possible to simplify or improve the structure for shielding of noise caused by the fan motor assembly 50. That is, rather than providing a dual motor chamber surrounding the fan motor 51, a single chamber may be provided. In this embodiment, a single motor chamber may be formed by joining the upper motor chamber 52 to the lower motor chamber 53, as described above. This may remarkably reduce noise due to the discharge air using the space on the lateral side of the body cover 21.

Figure 8:
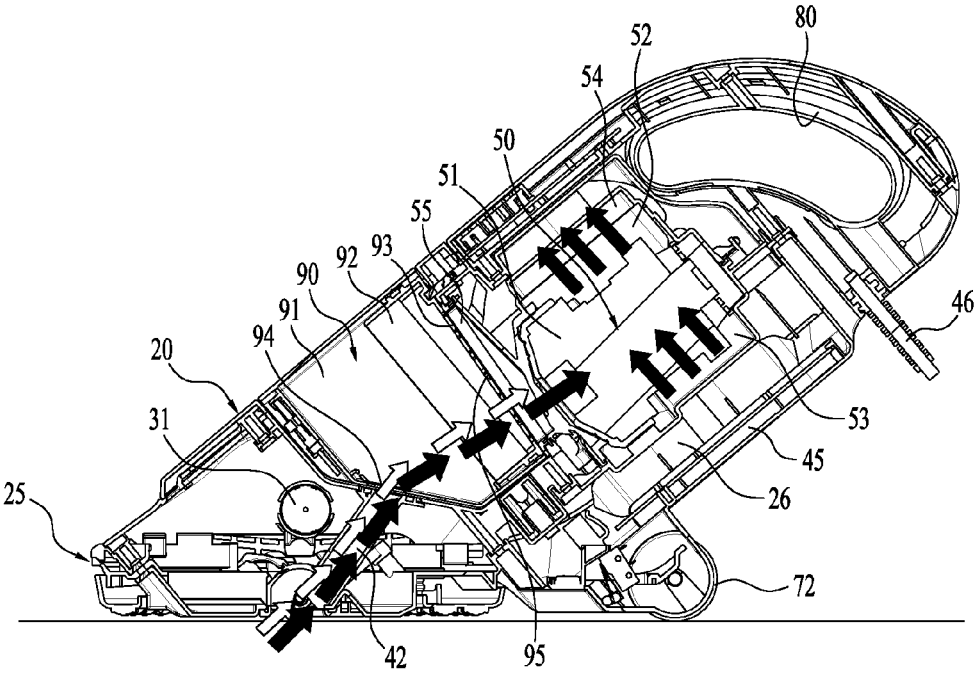
FIG. 8 is a lateral cross-sectional view illustrating the cleaner shown in FIG. 5.
Figure 9:
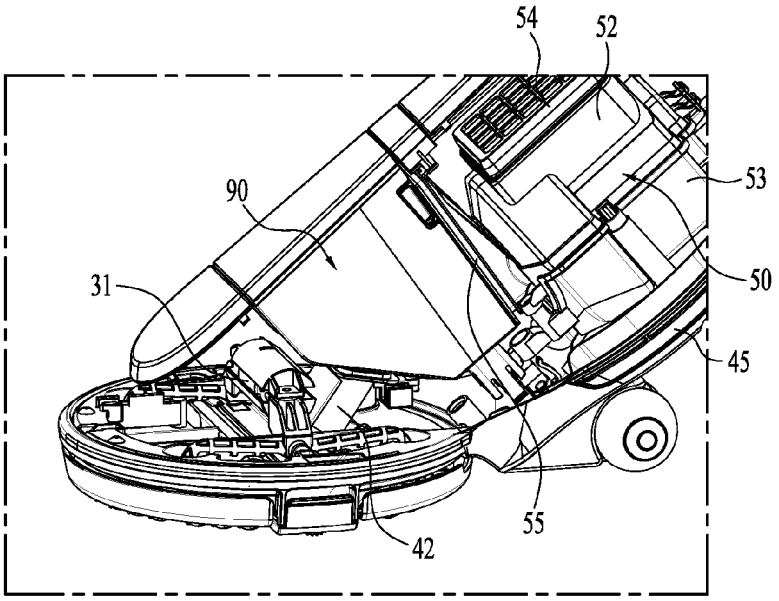
FIG. 9 is a perspective cross-sectional view illustrating the front portion of the cleaner shown in FIG. 5.

According to one embodiment as shown in FIG. 8, the air flow path is inclined upward as it extends rearward from the nozzle suction port 26 (see FIG. 15) to the fan motor 51. That is, the air flow path is formed in the direction substantially identical to the direction of inclination of the main body 20. This means that air flows smoothly with the direction of the air flow path in the main body 20 and is kept constant.

Specifically, in FIG. 8, the white arrows represent a flow path of dust, and the black arrows represent a flow path of the air. The dust is introduced into the dust container in the direction of inclination, and the air is introduced into the fan motor 51 in the direction of inclination. The air may be introduced into the upper portion of the fan motor 51 from the lower portion of the fan motor 51.

As shown in FIG. 8, the positional relation between the wheel 72 and the center of gravity of the fan motor 51 is important. The fan motor 51 or the fan motor assembly 50 is relatively heavy. Accordingly, the weight of these motors accounts for a greater portion of the overall weight of the cleaner.

Preferably, positions of the wheel 72 and the support bracket 71 are determined in consideration of the center of gravity of the fan motor 51 or the fan motor assembly 50. Preferably, the position where the fan motor assembly 50 is mounted is determined in consideration of the positions of the wheel 72 and the support bracket 71.

Specifically, the center of gravity of the fan motor assembly 50 is preferably positioned at the front side of the support point, which is formed through the wheel 72, to enhance travel stability. Accordingly, the mounting position of the fan motor assembly 50 as above allows the center of gravity of the cleaner 200 to be easily moved forward of the wheel 72. In addition, as described above, in the case that a battery is mounted, the center of gravity of the cleaner may be further moved forward.

However, even when mounting of the battery is considered, the center of gravity of the cleaner according to this embodiment is preferably positioned at the rear side of the suction nozzle part 25 and the front side of the support 70. In other words, the center of gravity of the cleaner 200 is preferably positioned perpendicularly over the second base body 24, which is inclined upward as it extends rearward, with respect to the ground. Accordingly, when the cleaner is configured to be of either the charging type or the power source-connection type, travel stability may be secured.

Hereinafter, the vibration system 30 of a cleaner according to one embodiment of the present invention will be described in detail with reference to FIGS. 10 to 14.

Figure 10:
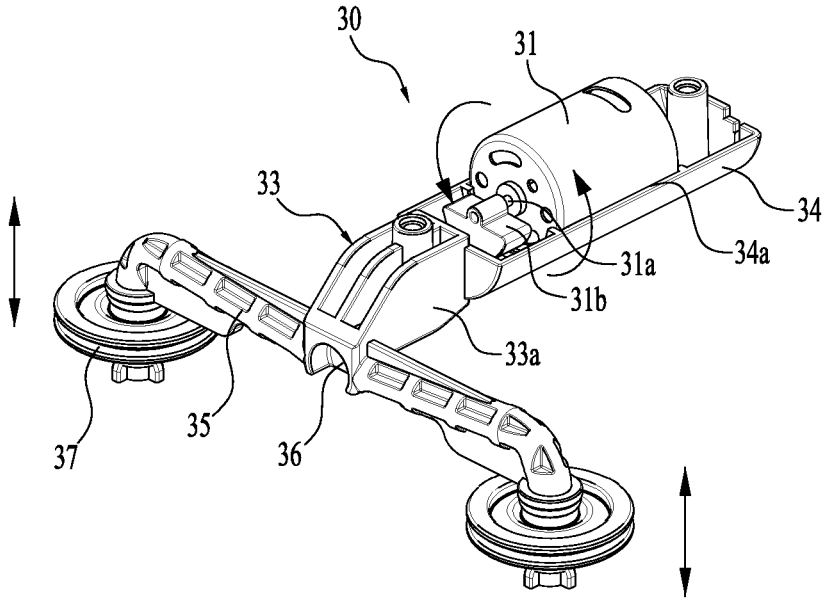
FIG. 10 is a perspective view illustrating a vibration system of the cleaner shown in FIG. 5.

Generation and transfer mechanism of vibration will first be described with reference to FIGS. 10 to 12.

In this embodiment, vibration is generated by rotation of the vibration motor 31. To this end, an eccentric weight 31*b* may be connected to a rotating shaft 31*a* of the vibration motor 31. Accordingly, the eccentric weight 31*b* is rotated by rotation of the rotating shaft 31*a*, and vibration is produced in the entire motor by rotation of the eccentric weight 31*b*. Accordingly, vibration is generated in a very simple and convenient way. In other words, by the eccentric load applied to the rotating shaft 31*a* of the motor, the motor is vibrated.

The vibration of the motor may be transferred to the vibration plate 32 via a vibration transfer member 33.

The vibration transfer member 33 may include a motor accommodation portion 34 to accommodate the motor 31, and a connection member 35 to connect the motor accommodation portion 34 to the vibration plate 32.

Specifically, the vibration transfer member 33 or the motor accommodation portion 34 may include a hinge pivot 36, and the connection member may be rotatably connected to the hinge pivot. That is, one side of the connection member may be rotatably connected to the hinge pivot, and the other side of the connection member may be connected to the vibration plate 32.

In addition, the motor accommodation portion 34 or the vibration transfer member 33 may include a spacing member 33*a*. The spacing member 33*a* functions to space the rotating shaft 31*a* of the motor apart from the hinge pivot 36. That is, the spacing member 33*a* functions to connect a motor seating portion 34*a*, in which the motor is seated, to the connection member 35.

Figure 11:
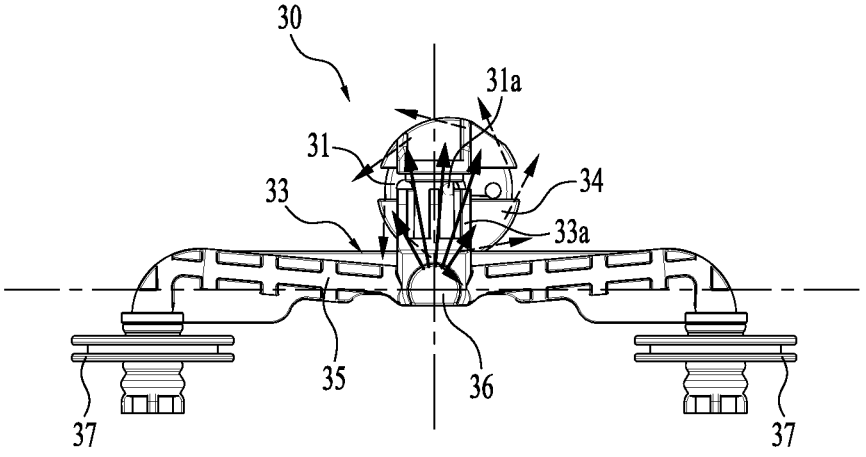
FIG. 11 is a cross-sectional view illustrating the vibration system of the cleaner shown in FIG. 10.

As shown in FIG. 11, when the eccentric weight 31*b* rotates, force is generated in the tangential direction of the rotational motion (indicated by the dotted arrows). When the eccentric weight 31*b* rotates about the hinge pivot 36, the moment distance (indicated by the solid-line arrows) varies. The tangential force and the varying moment distance generate rotational force of the hinge pivot 36. In addition, the tangential force and the varying moment distance vary the direction of rotation and the rotational force. Accordingly, when the eccentric weight 31*b* rotates, rotational force is transformed about the hinge pivot 36 in alternating clockwise and counterclockwise force.

That is, rotational force is transformed about the hinge pivot 36 due to misalignment of the rotating shaft 31*a* of the motor and the hinge pivot 36. In other words, the hinge pivot 36 is positioned at one side around the rotating shaft 31*a*, and moment is generated about the hinge pivot 36. This moment alternately changes the directions of rotation according to change in the rotational angle of the motor.

As the rotating shaft 31*a* and the hinge pivot 36 are vertically and longitudinally spaced apart from each other, the directions of rotation are alternated. In addition, the rotating shaft 31*a* and the hinge pivot 36 are spaced apart from each other by the spacing member 33*a*.

Figure 12:
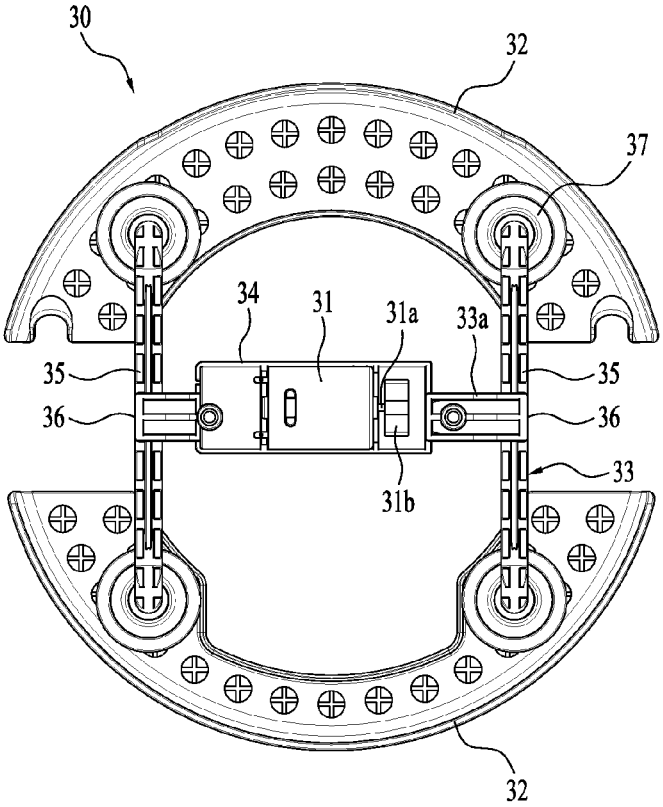
FIG. 12 is a plan view illustrating the vibration system of the cleaner shown in FIG. 10, which is provided with a vibration plate.

The connection member 35 may be arranged to extend forward and backward of the hinge pivot 36 referring to the orientation shown in FIG. 12. Accordingly, the center of the connection member 35 may be arranged to rotate with respect to the hinge pivot 36.

According to vibration of the motor 31, the front and back of the connection member 35 are vibrated in the opposite directions.

Specifically, as shown in FIG. 11, the hinge pivot 36 is positioned below and spaced apart from the rotating shaft 31*a* of the motor, and the center thereof is eccentrically positioned forward or backward. The front and back of the connection member 35 may rotate about the hinge pivot 36. That is, when the front of the connection member 35 rotates upward, the back of the connection member 35 rotates downward. Then, by rotation of the motor, the front of the connection member 35 rotates downward, and the back of the connection member 35 rotates upward.

Since the motor 31 rotates at a high rate of rotation, the front and back of connection member vibrate very quickly in a vertical direction. The directions of vibration of the front and back of the connection member may be opposite to each other. The vertical amplitude of the vibration may be limited by the elastic member 37. In other words, the vertical amplitude of vibration of the connection member 35 is limited by an elastic member 37. Accordingly, the elastic member 37 may function as a damper to allow a certain amplitude of vibration of the connection member 35 (e.g., 3 mm to 4 mm) and prevent any further rotation of the connection member.

According to this embodiment, the cleaner 200 vibrate two vibration plates using one vibration motor 31.

As shown in FIG. 12, the hinge pivot 36 and the connection member 35 may be provided on both sides of the vibration motor 31.

The two hinge pivots 36 may be coaxially arranged, and separate vibration plates may be separately provided to the front and back of the hinge pivots 36. In other words, separate vibration plates may be provided to the front and rear side of the hinge pivots 36 with respect to the co-axis of the hinge pivots 36.

Due to eccentric arrangement of the two hinge pivots 36 with respect to the rotating shaft of the vibration motor 31, the connection members 35 may have opposite directions of vibration, as discussed above. That is, as shown in FIG. 12, the connection members 35 are arranged to vibrate left and right in the same direction.

Accordingly, when the vibration plate 32 arranged at the front side moves downward, the vibration plate 32 arranged at the rear side moves upward. On the other hand, when the vibration plate 32 arranged at the front side moves upward, the vibration plate 32 arranged at the rear side moves downward. Accordingly, the directions of vibration generated at the front and back of the suction nozzle part 25 are opposite to each other.

Due to the arrangement and cross-vibration of the two vibration plates 32 as discussed above, vibration may be applied to a larger area, remarkably reducing the time taken to perform cleaning. In addition, the number of applied vibrations per second may be doubled. Accordingly, the efficiency of cleaning may be remarkably increased.

Hereinafter, the mounting structure of the vibration system 30 will be described in detail with reference to FIGS. 13 to 15.

Figure 15:
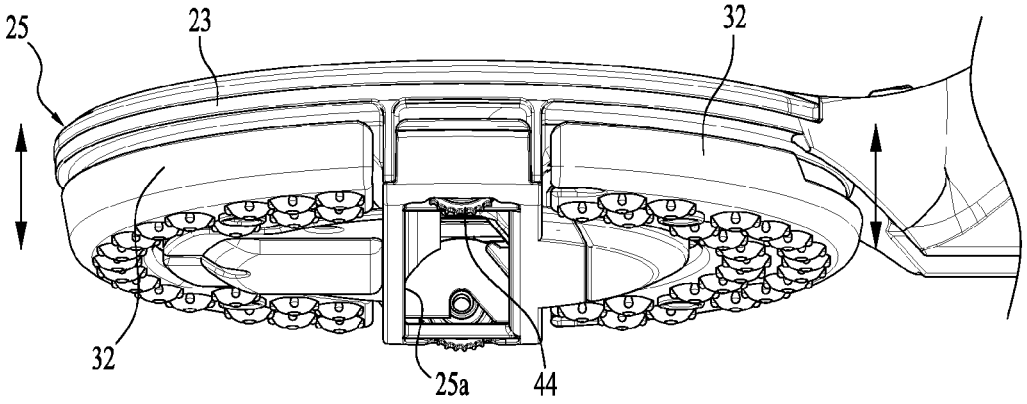
FIG. 15 is a partial perspective view illustrating the lower portion of the suction nozzle part of the cleaner shown in FIG. 5.

As shown in FIG. 15, the suction nozzle part 25 may be formed in a circular shape. In addition, a suction port 25*a* which extends to the left and right sides may be formed at the lower central portion of the suction nozzle part 25. That is, the direction of extension of the suction port 25*a* may be substantially perpendicular to the travel direction of the cleaner 200. In other words, the suction port 25*a* may be formed in the shape of a rectangle which is long in the lateral direction and short in the front-back direction.

The suction port 25*a* may be defined by the air guide 42. That is, one end of the air guide 42 may define the suction port 25*a*, and the other end of the air guide 42 may be inclined upward as it extends rearward. The suction port 25*a* may be connected to the one end of the air guide 42.

Preferably, the vibration plates 32 are arranged at the lower portion of the suction nozzle part 25 and at the front and back of the suction port 25*a*. Herein, the outer shape of the vibration plates 32 preferably corresponds to that of the suction nozzle part 25. That is, the suction nozzle part 25 may have a circular shape, and therefore the outer shape of the vibration plates 32, i.e., the shape of the edge of each of the vibration plates 32 may be semicircular. Preferably, the two vibration plates 32 form a circular shape.

Figure 13:
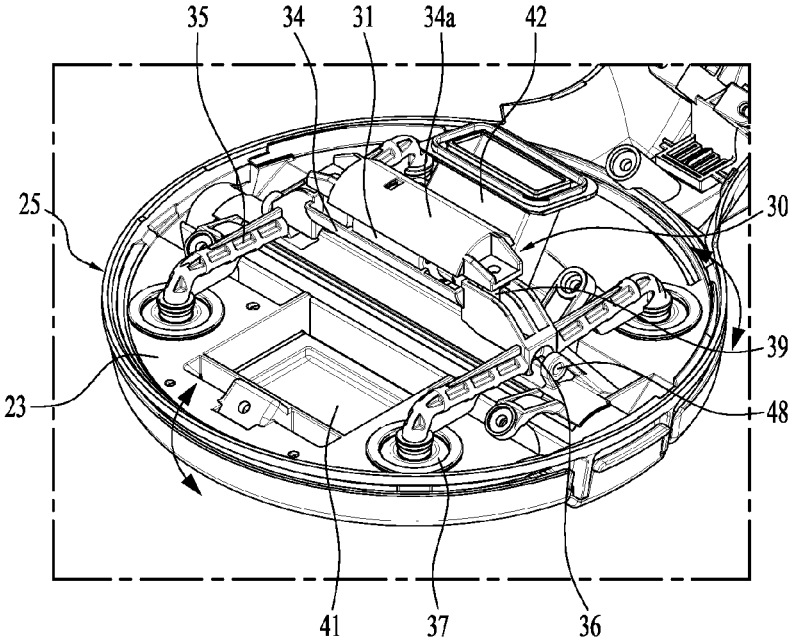
FIG. 13 is a partial perspective view illustrating the upper portion of a suction nozzle part of the cleaner shown in FIG. 5.

As shown in FIG. 13, the vibration motor 31 is preferably positioned to be substantially over the suction port 25*a*. That is, the longitudinal direction of the vibration motor 31 is preferably parallel with that of the suction port 25*a* and substantially over the suction port 25*a*.

Figure 2:
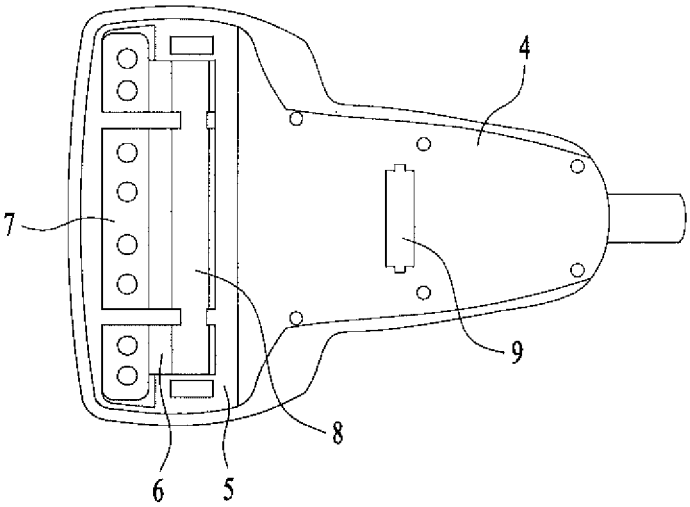
FIG. 2 PRIOR ART
FIG. 2 is a bottom view illustrating the bedding cleaner shown in FIG. 1.
Figure 3:
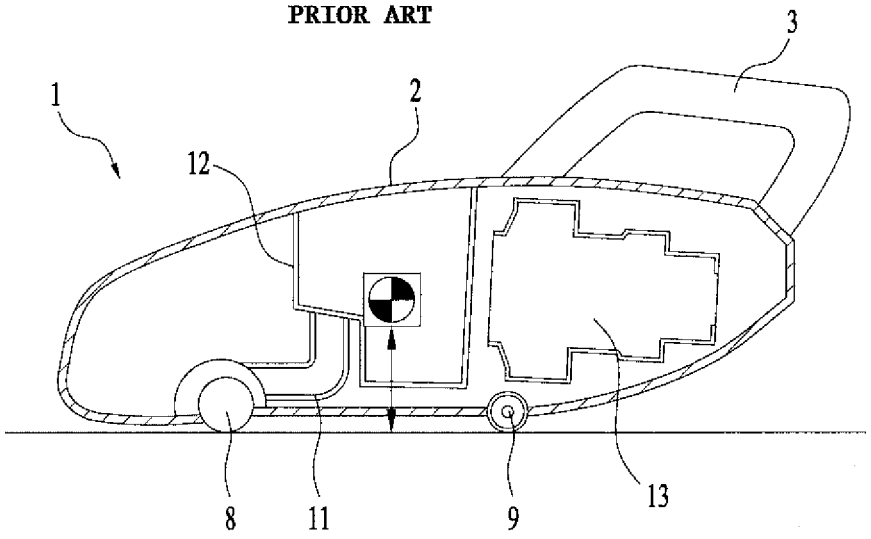
FIG. 3 PRIOR ART
FIG. 3 is a lateral cross-sectional view illustrating the bedding cleaner shown in FIG. 1.
Figure 4:
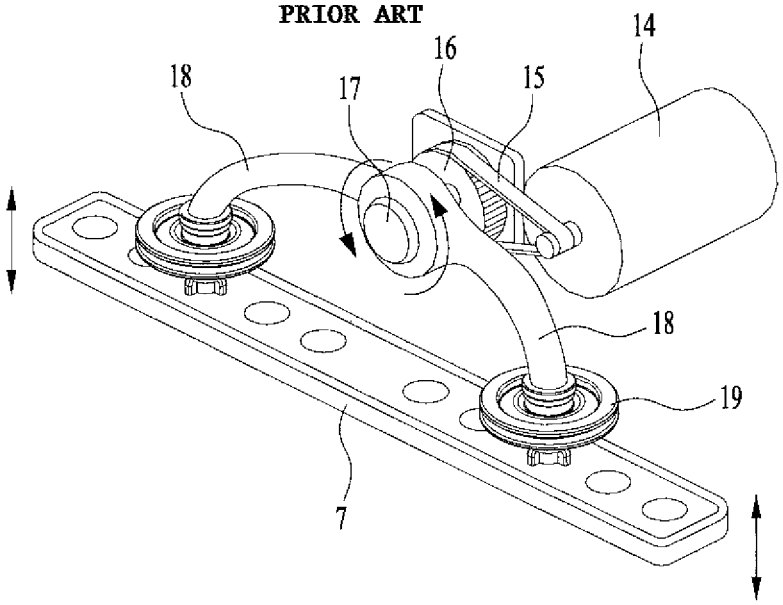
FIG. 4 PRIOR ART
FIG. 4 is a perspective view illustrating a vibration system of the bedding cleaner shown in FIG. 1.

Referring to FIGS. 2 and 4, in the case of the conventional vibration system, the longitudinal direction of the motor 14 is perpendicular to the longitudinal direction of the suction port 6. In addition, the motor 14 is positioned at the rear side of the suction port 6. In addition, due to the mechanism of transfer of vibration between the motor 14 and the vibration plate 7, the structure of the flow path from the suction port to 6 to the dust container 12 is disadvantageously complex. That is, as shown in FIG. 3, the direction of air flow is frequently changed in the structure of the air guide 11.

On the other hand, according to this embodiment as shown in FIG. 13, the vibration motor 31 is arranged over the suction port 25*a*, and thus the shape of the air guide 42 is simplified as the air guide 42 is inclined rearward. Thereby, the motor accommodation portion 34 or the connection member 35 and the air guide 42 do not interfere with each other by the positional relation therebetween.

According to this embodiment, the entire motor 31 vibrates as described above. Accordingly, the motor accommodation portion 34 and the connection member 35 also vibrate. That is, the entire vibration system 30 vibrates. Therefore, the vibration system 30 needs to be stably fixed, and produced vibration needs to be effectively transferred to the vibration plates 32.

First, the rotating motor needs to be protected from an external environment. Accordingly, a cover to protect the motor 31 needs to be provided at the upper portion of the motor 31. Since the motor 31 is seated in the seating portion 34*a* of the motor accommodation portion 34, the cover is preferably a motor accommodation portion cover 34*a* to cover the motor accommodation portion 34.

As discussed above, the entire motor 31 vibrates. Accordingly, in the case that the motor accommodation portion cover 34*a* directly contacts the motor 31, the motor accommodation portion cover 34*a* may vibrate and produce noise. Accordingly, the motor accommodation portion cover 34*a* is preferably positioned to be spaced apart from the motor.

Figure 14:
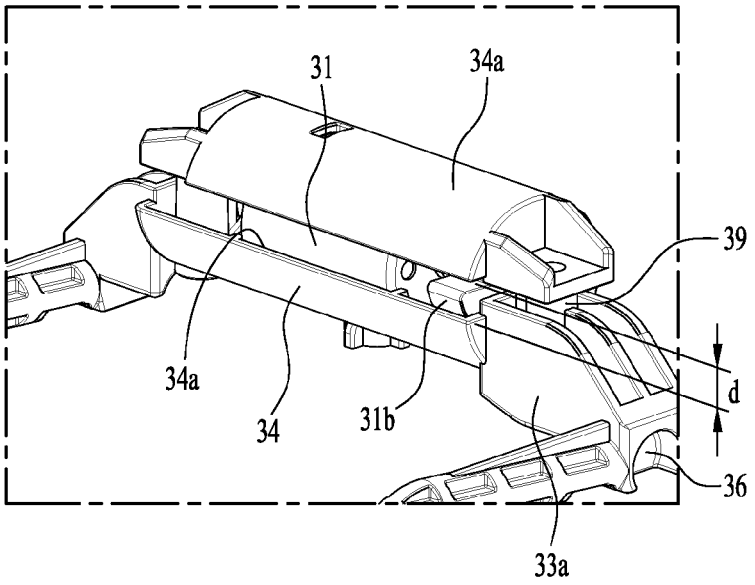
FIG. 14 is a perspective view illustrating a motor accommodation portion of the vibration system shown in FIG. 10.

To this end, the motor accommodation portion cover 34*a* is preferably joined to a spacing member 33*a*, as shown in FIG. 14. In addition, the motor accommodation portion cover 34*a* and the spacing member 33*a* are preferably joined to each other with a predetermined gap d placed therebetween.

To this end, the spacing member 33*a* may be provided with a boss 39 protruding upward. In addition, the bosses 39 may be formed at the front and back of the motor in the longitudinal direction of the motor. When seated on the boss 39, the motor accommodation portion cover 34*a* may be joined to the spacing member 33*a* by screws.

An elastic member (not shown) may be provided inside the motor accommodation portion cover 34*a* to minimize noise produced by possible contact between the motor 31 and the motor accommodation portion cover 34*a*.

As shown in FIG. 13, most constituents of the vibration system 30 are positioned at the upper portion of the first base body 23. Herein, the vibration system 30 is preferably elastically supported by the first base body 23.

Vibration of the motor 31, the motor accommodation portion 34 and the spacing member 33*a* is converted into vibration of the connection member 35, as discussed above. That is, the tangential force produced by rotation of the eccentric weight 31*b* is converted into the rotational force about the hinge pivot 36. Accordingly, by limiting the translational motion at the hinge pivot 36, the motor 31, the motor accommodation portion 34 and the spacing member 33*a* may be fixed to the suction nozzle part 25 or the first base body 23.

To this end, a hinge pivot fixing member 48 may be provided to the upper portion of the first base body 23. The hinge pivot fixing member 48 is joined to the hinge pivot 36 to limit the translational motion at the hinge pivot 36. On the other hand, by rotational force about the hinge pivot 36, the directions of rotation of the connection member 35 are alternately changed to transfer vibration to the vibration plates 23.

Accordingly, the motor 31 may be stably supported on the first base body 23 by the hinge pivot fixing member 48.

Hereinafter, the structure of elastic support of the vibration system 30, particularly the structure of elastic support of the vibration plates 32 will be described in detail with reference to FIGS. 16 to 18. In addition, a detailed description will be given of the shape of the vibration plates 32 and a structure to protect the vibration plates 32.

It can be seen from FIGS. 5, 6 and 15 that the vibration plates 32 according to one embodiment of the present invention may be visibly exposed to the outside. That is, when the bedding is cleaned using the cleaner 200, the user 3 may visibly check vibration of the vibration plate 32.

The vibration plates 32 may be provided to effectively perform cleaning by applying vibration to the bedding. Accordingly, the user may strongly desire to visibly check whether the vibration plate 32 applies vibration to the bedding. In other words, to satisfy the user's desire to see and sense the vibration, the vibration plate 32 is preferably exposed to the outside of the cleaner 200.

As shown in FIGS. 1 and 2, in the case of the conventional bedding cleaner, the vibration plate 7 is not exposed to the outside of the cleaner 1. Accordingly, it may be difficult for the user to check whether the vibration plate 7 operates normally, how much vibration is applied, and how much dust is lifted from the bedding by the vibration plate 7.

To address these disadvantages, the cleaner according to this embodiment is provided with the vibration plate 32 positioned to be exposed to the outside at the position where the cleaner operates. Accordingly, by visualizing striking of the bedding by the vibration plate 32, reliability of cleaning may be enhanced.

To this end, the suction nozzle part 25 of the cleaner may be formed in a circular shape, the vibration plate 32 may be formed in a circular or semicircular shape corresponding to the outer shape of the suction nozzle part 25. That is, the outer shape of the vibration plate 32 may correspond to that of the first base body 23.

However, since the vibration plate 32 is a constituent to vibrate, the vibration plate 32 needs to be allowed to vibrate while connected to the first base body 23. In addition, the vibration plate 32 may be damaged when contacting a hard object during cleaning. Accordingly, the vibration plate 32 is preferably allowed to vibrate and to avoid contact with hard objects on the floor except the bedding while being exposed to the outside.

Figure 16:
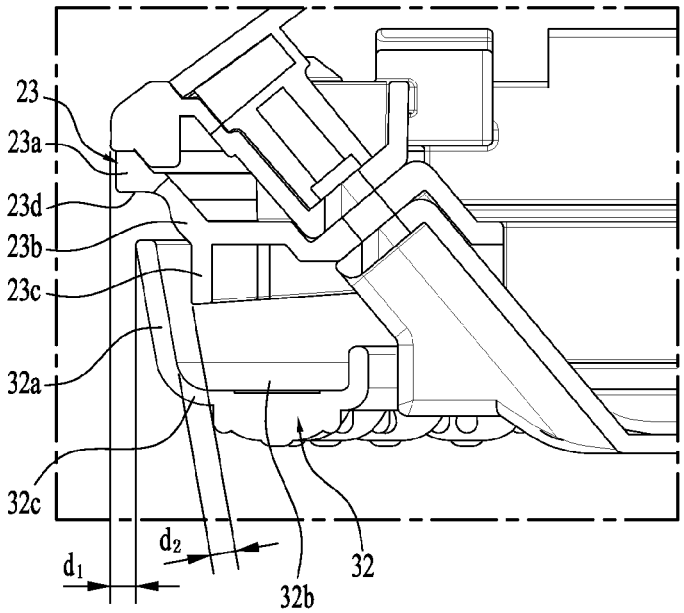
FIG. 16 is a partial cross-sectional view illustrating the suction nozzle part shown in FIG. 5.

To this end, as shown in FIG. 16, the vibration plate 32 is preferably provided with a bottom portion 32*b* and a lateral portion 32*a*. The lateral portion 32*a* may be formed to have a height greater than the thickness of the bottom portion 32*b*. Accordingly, the lateral portion 32*a* may be substantially exposed to the outside of the cleaner 200.

When a mattress or the bedding on a bed is cleaned, the cleaner 200 may hit a bedside table, a head board or the wall. In this case, the vibrating vibration plate may hit the bedside table, a head board or wall to produce noise, or may be damaged by shock. In addition, in the case that the cleaner is dropped, shock may be directly applied to the vibration plate 32. Accordingly, in the case that the vibration plate 32 is exposed to the outside, the vibration plate 32 may be damaged, out of joint, or deformed.

As shown in FIG. 16, the outermost side of the vibration plate 32 is preferably positioned inside the suction nozzle part 25 or the first base frame 24. In the case that the suction nozzle part 25 is formed in a circular shape, the outermost side of the vibration plate 32 is preferably positioned at a predetermined distance within the suction nozzle part 25 in a radial direction. Thereby, the vibration plate 32 may be prevented from hitting the wall during cleaning. That is, the first base body 24, the main body 20 or the body cover 21 directly hits the wall in place of the vibration plate 32.

Accordingly, the vibration plate 32, particularly the lateral portion 32*a* of the vibration plate that forms the edge of the vibration plate 32 is preferably positioned at a predetermined distance within the suction nozzle part 25 with respect to the entire edge of the suction nozzle part 25. In other words, in the case that the suction nozzle part 25 is formed in a circular shape, the largest radius of the vibration plate is preferably less than the largest radius of the suction nozzle part. In the case that the suction nozzle part 25 is formed in other shapes such as a polygon, the vibration plate may be positioned a predetermined length within the suction nozzle part in a radial direction.

Meanwhile, since the vibration plate 32 vibrates in a vertical direction, the vibration plate 32 needs to avoid contact with the first base body 23 during vibration.

The body of the suction nozzle part or the first base body 24 may include an upper outer vertical wall 23*a*. The upper outer vertical wall 23*a* may substantially form the outermost side of the suction nozzle part 25. The upper outer vertical wall 23*a* may directly contact an external wall, and thus the vibration plate 32 may be protected.

The first base body 24 may include a lower outer vertical wall 23*b* positioned radially inward at the lower portion of the upper outer vertical wall 23*a* to avoid interference with vertical vibration of the vibration plate 32, particularly, the lateral portion 32*a*. In other words, the uppermost end of the lateral portion 32*a* may be positioned between the upper outer vertical wall 23*a* and the lower outer vertical wall 23*b*. In addition, a horizontal wall 23*d* may be formed between the upper outer vertical wall 23*a* and the lower outer vertical wall 23*b*. In other words, the lower outer vertical wall 23*b* may be positioned radially inside of the first base body 24 by a distance defined by the horizontal wall 23*d*.

The uppermost end of the lateral portion 23*c* is spaced a predetermined distance from the horizontal wall 23*d*. That is, the predetermined distance is preferably greater than the allowable amplitude of vibration of the vibration plate 23. Accordingly, under the normal condition of vibration of the vibration plate 23, the vibration plate 23 may be prevented from contacting the first base body 24.

Meanwhile, a curved portion 32*c* is preferably provided between the bottom portion 32*b* and the lateral portion 32*a* of the vibration plate 23. That is, the bottom portion 32*b* may be integrated with the lateral portion 32*a* through the curved portion 32*c*. The curved portion 32*c* may be formed in a round shape, thereby increasing the area subjected to external shock.

The lateral portion 32*a* preferably expands radially outward as it extends upward. In other words, the lateral portion 32*a* has the largest radius at the uppermost end of the lateral portion 32*a*. This is intended to visibly expose the lateral portion 32*a* to the outside as much as possible and to minimize the exposure distance of the entire lateral portion 32*a* (the distance from the lateral portion 32*a* to the outermost side of the first base body).

As discussed above, the vibration plate 23 is elastically supported by the first base body 24 through the elastic member 37. The elastic member 37 functions to determine the amplitude of vibration of the vibration plate 23 and to absorb external shock applied to the vibration plate 23. For example, in the case that the cleaner which is not in operation is dropped, external shock may be applied to the vibration plate 23. At this time, a major part of the shock may be absorbed by the elastic member 37.

However, due to the external shock, the vibration plate 23 may be moved beyond the allowable spacing distance. For example, when the amplitude of vibration is 3 mm to 4 mm during cleaning, the vibration plate 23 may be moved beyond an allowable spacing distance in a vertical direction or in the front-back direction due to the external shock.

At this time, the vibration plate 23 may be separated from the connection member 35 or the elastic member 37. In addition, due to the external shock, the vibration plate 23 may be damaged or deformed.

To address these problems, the horizontal portion 23*d* disclosed above limits excessive rise of the vibration plate 23. In addition, to prevent excessive inward movement of the vibration plate 23 in a radial direction, a reinforcement rib 23*c* may be provided.

The reinforcement rib 23*c* may be positioned to correspond to the lateral portion 32*a* of the vibration plate 23. That is, to prevent excessive inward movement of the vibration plate 23 in a radial direction, the reinforcement rib 23*c* may be provided.

The reinforcement rib 23*c* may be positioned at a lower portion of the lower outer vertical wall 23*b*. In addition, the reinforcement rib 23*c* may extend downward from a radially inner side of the lower outer vertical wall 23*b*. Accordingly, when the lateral portion 32*a* of the vibration plate 23 is excessively moved radially inward by the external shock, the lateral portion 32*a* comes into contact with the reinforcement rib 23*c*.

Accordingly, strong external shock may be transferred to the strong first base body 24 via the reinforcement rib 23*c*. That is, by absorbing the strong external shock, damage to the vibration plate 23 may be prevented.

Hereinafter, a detailed description will be given of the elastic member 37 and a structure of elastic support of the vibration system 30 using the elastic member 37 with reference to FIGS. 17 and 18.

The first base body 24 is provided with a connection hole 47. The upper and lower portions of the first base body 24 may communicate with each other through the connection hole 47. That is, the vibration at the upper portion of the first base body 24 may be transferred to the vibration plate 32 at the lower portion of the first base body 24 through the connection hole 47.

Specifically, the connection member 35 leads to the lower portion of the suction nozzle part 25 through the connection hole 47. The vibration plate 32 is connected to the end of the connection member 35. Herein, to elastically support the connection member 35 and the vibration plate 32, the connection hole 47 is provided with an elastic member 37.

The elastic member 37 includes a flange 37*a* fixed to the rim of the connection hole 47. As shown in FIG. 18, the flange 37*a* is inserted into the upper and lower portions of the rim of the connection hole 47. Accordingly, the elastic member 37 may be fixed to the first base body 24 through the flange 37*a*.

A through hole 37*b* may be formed at a radially inner side of the flange 37*a*, i.e., at the central portion of the elastic member 37. The through hole 37*b* may have a predetermined height, and an inner radius thereof may vary to form a wrinkled pattern.

The connection member 35 may pass through the through hole 37*b*. Accordingly, the connection member 35 is fixed to the through hole 37*b*, and thereby the connection member 35 may be elastically supported by the first base body 24. In addition, the vibration plate 32 may be joined to the end of the connection member 35 positioned by passing through the through hole 37*b*. Accordingly, the vibration plate 32 may also be elastically supported by the first base body 24 through the connection member 35.

The elastic member 37 may include an extension portion 37*c* formed between the flange 37*a* and the through hole 37*b*. The flange 37*a* is fixed to the first base body 24 and the through hole 37*b*, and is vertically moved by vibration. Accordingly, the extension portion 37*c* may substantially apply an elastic force. Therefore, the extension portion 37*c* is preferably formed in the shape of a diaphragm. Thereby, the range of vertical movement of the connection member 35 and the vibration plate 32 may be limited, and external shock applied to the vibration plate 32 may be absorbed.

However, the external shock may cause excessive movement of the vibration plate 32, resulting in the elastic member 37 slipping from the first base body 24. Particularly, the elastic member 37 may slip from the through hole 37*b*.

Figure 17:
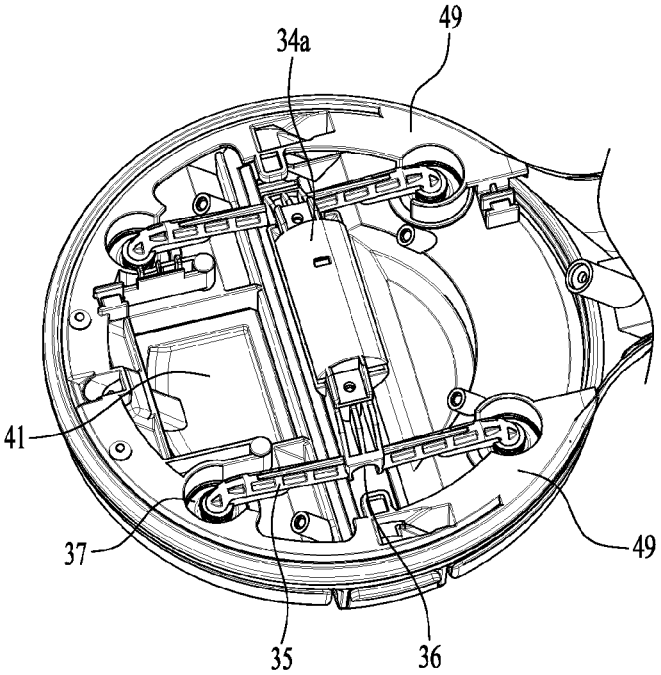
FIG. 17 is a partial perspective view illustrating a suction nozzle part including a pressing member shown in FIG. 5.

As shown in FIG. 17, a pressing member 49 may be joined to the upper portion of the first base body 24. That is, to allow the through hole 37*b* to be more securely joined to the elastic member 37, the pressing member 49 may be provided to the first base body 24.

Figure 18:
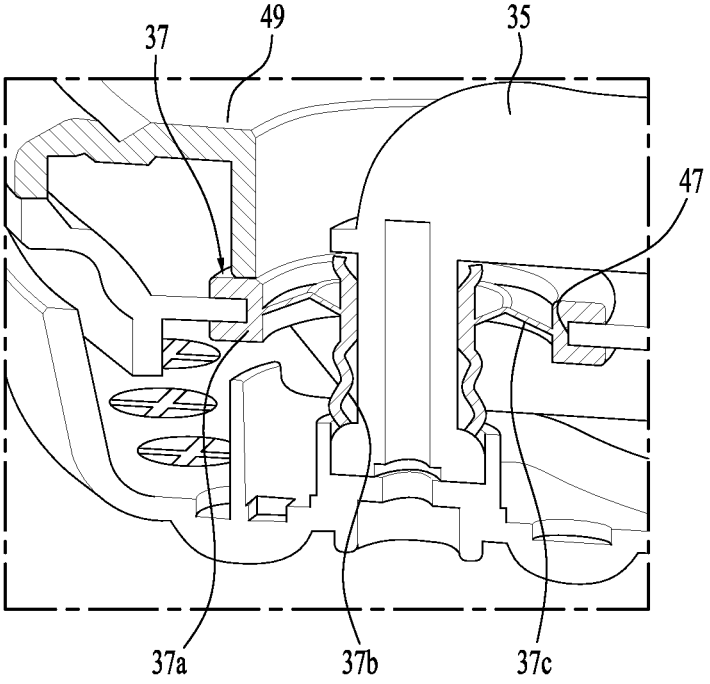
FIG. 18 is a cross-sectional view illustrating the structures of the elastic support and pressing member of the cleaner shown in FIG. 5.

Specifically, as shown in FIG. 18, the pressing member 49 may be arranged to apply pressure to the flange 37*a* of the elastic member 37. The pressing member 49 allows the flange 37*a* to more closely contact the through hole 37*b*. Further, when the flange 37*a* moves upward or downward, the movement thereof is restricted by the pressing member 49. Accordingly, the elastic member 37 may be more securely joined to the first base body 24. This means that the vibration system 30 may be more securely and elastically supported by the first base body 24 when the external shock is applied thereto.

The pressing member 49 may be adapted to apply pressure to the upper portion or lower portion of the flange 37*a*, or to only one side of the flange 37*a*. In the example shown in FIGS. 17 and 18, pressure is applied only to the upper portion of the flange 37*a*. Additionally, the pressing member 49 may apply pressure to the entire flange 37*a* along the circumferential direction of the flange 37*a*.

The connection member 35 needs to extend from the vibration motor 31 and be connected to the through hole 37*b* via a portion of the flange 37*a*. Accordingly, as shown in FIG. 17, the pressing member 49 may be adapted to apply pressure only to the portion of the flange 37 other than the extension path of the connection member.

In addition, the pressing member 49 is preferably joined to the body of the suction nozzle part 25 or the first base body 24, separately from the elastic member 37. In other words, the pressing member 49 may be joined to the first base body 24 through a separate joining means (e.g., a screw, which is not shown). Such joining means may be irrelevant to the vibration system 30. Accordingly, joining the pressing member 49 to the first base body 24 may be secured even when vibration is caused. Accordingly, the pressing force applied to the elastic member 37 by the pressing member 49 does not change even when vibration is caused. Therefore, slipping of the elastic member 37 from the first base body 24 may be effectively prevented.

As is apparent from the above description, the following effects may be obtained.

According to one embodiment of the present invention, a cleaner may be provided with a vibration system which may be easily implemented and have enhanced durability and reliability.

According to one embodiment of the present invention, a cleaner may enhance the vibration effect by allowing a motor to vibrate and converting vibration of the motor into vibration of a vibration plate.

According to one embodiment of the present invention, a cleaner may simplify and facilitate fixing of the vibration system.

According to one embodiment of the present invention, a cleaner may enhance cleaning effect by vibrating two vibration plates through one vibration motor.

According to one embodiment of the present invention, a cleaner may easily maintain balance between two vibration plates by positioning a vibration motor over a suction port.

According to one embodiment of the present invention, a cleaner may minimize inconvenience of bending at the waist during cleaning and may thus be easy to use.

According to one embodiment of the present invention, a cleaner may enhance cleaning effect by allowing the nozzle part to more closely contact the ground or the bedding.

According to one embodiment of the present invention, a cleaner may secure travel stability during cleaning and may thus be easy to use.

According to one embodiment of the present invention, a cleaner may enhance cleaning efficiency and reduce noise by ensuring smoother flow of air in the cleaner.

It will be apparent to those skilled in the art that various modifications and variations can be made without departing from the spirit or scope of the inventions. Thus, it is intended that the modifications and variations be covered by the appended claims and their equivalents.

What is claimed is:

1. A vacuum cleaner to suction dust by applying vibration, the vacuum cleaner comprising:

a body;

a fan motor provided in the body to suction dust;

a suction nozzle part at a portion of the body;

a motor in the body, the motor including a rotating shaft;

an eccentric load at the rotating shaft of the motor, which when rotated by a rotation of the rotating shaft, a vibration force is produced by a vibration of the motor;

at least one vibration plate located at the suction nozzle part to apply the vibration force to an object to be cleaned; and a vibration transfer member to transfer the vibration force to the at least one vibration plate, wherein the vibration transfer member comprises:

a motor accommodation portion which accommodates the motor and is provided with at least one hinge pivot; and at least one connection member to connect the motor accommodation portion to the at least one vibration plate, wherein the at least one connection member is rotatably connected to the at least one hinge pivot;

wherein the at least one hinge pivot is eccentrically positioned forward or rearward of the rotating shaft of the motor in a horizontal direction of the rotating shaft.

2. The vacuum cleaner according to claim 1, wherein one connection member extends from one side of the at least one hinge pivot and another connection member extends from another side of the at least one hinge pivot.

3. The vacuum cleaner according to claim 2, wherein one side of the one connection member is rotatably connected to the at least one hinge pivot and other side of the one connection member is connected to one vibration plate, and one side of the another connection member is rotatably connected to the at least one hinge pivot and other side of the another connection member is connected to another vibration plate.

4. The vacuum cleaner according to claim 1, wherein the at least one hinge pivot is arranged at a lower portion of the rotating shaft of the motor and spaced apart from the rotating shaft.

5. The vacuum cleaner according to claim 1, wherein the at least one hinge pivot comprises two hinge pivots, a hinge pivot provided on either side of the motor, and the at least one connection member is provided to each of the hinge pivot.

6. The vacuum cleaner according to claim 5, wherein the two hinge pivots are coaxially arranged and separate vibration plates are provided at either side of each of the hinge pivots and connected to a corresponding one of the at least one connection member.

7. The vacuum cleaner according to claim 1, further comprising at least one elastic member, wherein the motor, the at least one vibration plate and the at least one connection member are elastically supported by the body through the at least one elastic member.

8. The vacuum cleaner according to claim 7, wherein the at least one elastic member is arranged between the at least one connection member and the body and fixed, and amplitude of vertical vibration of the at least one vibration plate is restricted by elastic force of the at least one elastic member.

9. A vacuum cleaner to suction dust by applying vibration, the vacuum cleaner comprising:

a body;

a fan motor provided in the body to suction dust;

a suction nozzle part provided at a portion of the body to suction dust by applying vibration to an object, wherein the suction nozzle part comprises a suction port;

a vibration system comprising a motor and an eccentric load applied to a rotating shaft of the motor where a vibration is produced by a vibration of the motor when the eccentric load is rotated by a rotation of the rotating shaft;

two vibration plates located at the suction nozzle part to apply the vibration to the object and individually provided to front and back of the suction port; and at least one elastic member, wherein the vibration system is elastically supported by the body with respect to a direction of vibration of the vibration plate by the at least one elastic member, the vibration system comprising:

a motor accommodation portion which accommodates the motor;

at least one hinge pivot provided to the motor accommodation portion; and at least one connection member to connect the motor accommodation portion to the two vibration plates individually, wherein the at least one connection member extends from one side of the at least one hinge pivot and another connection member extends from another side of the at least one hinge pivot.

10. The vacuum cleaner according to claim 9, wherein the one connection member connects to one vibration plate through one elastic member and the another connection member connects to another vibration plate through another elastic member.

11. The vacuum cleaner according to claim 10, wherein the at least one hinge pivot comprises two hinge pivots, a hinge pivot provided on either side of the motor accommodation portion, the two vibration plates are arranged at front and rear sides of the motor accommodation portion and connected to the respective connection members.

12. The vacuum cleaner according to claim 9, further comprising at least one hinge pivot fixing member to fix the at least one hinge pivot to the body.

13. The vacuum cleaner according to claim 9, wherein the motor accommodation portion comprises:

a motor seating portion;

a spacing member to space the hinge pivot apart from the motor seating portion; and a motor accommodation portion cover joined to the spacing member to cover the motor seating portion and spaced apart from the motor seating portion.

14. The vacuum cleaner according to claim 9, further comprising a handle allowing a user to apply force thereto to manipulate the vacuum cleaner, the handle at one end of the body opposing the suction nozzle part at an other end of the body, wherein the body is inclined at an angle with respect to the suction nozzle part.

15. The vacuum cleaner according to claim 9, wherein the motor is positioned to be over the suction port and a longitudinal direction of the motor is parallel to the suction port.

* * * * *